US010706868B2

(12) United States Patent
Jhawar et al.

(10) Patent No.: US 10,706,868 B2
(45) Date of Patent: Jul. 7, 2020

(54) MULTI-MODE NOISE CANCELLATION FOR VOICE DETECTION

(71) Applicant: RealWear, Incorporated, Milpitas, CA (US)

(72) Inventors: Sanjay Subir Jhawar, Menlo Park, CA (US); Christopher Iain Parkinson, Richland, WA (US); Kenneth Lustig, Mercer Island, WA (US)

(73) Assignee: REALWEAR, INC., Vancouver, WA (US)

( * ) Notice: Subject to any disclaimer, the term of this patent is extended or adjusted under 35 U.S.C. 154(b) by 44 days.

(21) Appl. No.: 15/697,176

(22) Filed: Sep. 6, 2017

(65) Prior Publication Data

US 2019/0074023 A1 Mar. 7, 2019

(51) Int. Cl.
*H04R 1/10* (2006.01)
*G10L 21/02* (2013.01)
(Continued)

(52) U.S. Cl.
CPC ..... *G10L 21/02* (2013.01); *G10L 21/0208* (2013.01); *G10L 25/84* (2013.01);
(Continued)

(58) Field of Classification Search
CPC ..... H04R 1/1008
See application file for complete search history.

(56) References Cited

U.S. PATENT DOCUMENTS 7,983,907 B2 7/2011 Visser et al.
8,737,633 B2 * 5/2014 Sibbald ..... G10K 11/178 381/71.1

(Continued)

FOREIGN PATENT DOCUMENTS

WO 9728742 A2 8/1997
WO 2014128704 A1 8/2014

OTHER PUBLICATIONS

International Search Report and Written Opinion dated Nov. 8, 2018 in International Patent Application No. PCT/US2018/049380, 11 pages.

*Primary Examiner* — Feng-Tzer Tzeng
(74) *Attorney, Agent, or Firm* — Shook, Hardy & Bacon LLP

(57) ABSTRACT

Methods and systems provide dynamic selection of noise-cancelling algorithms, and dynamic activation and deactivation of microphones to provide multi-mode noise cancellation for a voice-detecting headset in situations where ambient noise prevents voice navigation from accurately interpreting voice commands. To do so, when an ambient noise is detected that exceeds a threshold, a particular noise-cancelling algorithm best-suited for the situation is selected, and one or more noise-detecting microphones is activated. The noise-detecting microphone(s) receiving the highest level of ambient noise can remain activated while the remaining noise-detecting microphones can be deactivated. A speech signal received by the speech microphone can then be optimized by cancelling the ambient noise signal received from the activated noise-detecting microphone(s) using the selected noise-cancelling algorithm. After the speech signal is optimized, it can be communicated to the voice-detecting headset for interpretation.

20 Claims, 5 Drawing Sheets

(51) Int. Cl.

| | |
|---|---|
| ***H04R 3/00*** | (2006.01) |
| ***G10L 25/84*** | (2013.01) |
| ***G10L 21/0208*** | (2013.01) |
| *H04S 7/00* | (2006.01) |

(52) U.S. Cl.
CPC ..... *H04R 1/1083* (2013.01); *H04R 3/00* (2013.01); *H04R 1/1008* (2013.01); *H04R 2460/13* (2013.01); *H04S 7/304* (2013.01)

(56) References Cited

U.S. PATENT DOCUMENTS

| | | | | |
|---|---|---|---|---|
| 9,330,675 | B2 * | 5/2016 | Zhang | G10L 21/0208 |
| 2003/0138119 | A1 * | 7/2003 | Pocino | H04M 3/561 381/119 |
| 2007/0009127 | A1 | 1/2007 | Klemenz et al. | |
| 2009/0238377 | A1 | 9/2009 | Ramakrishnan et al. | |
| 2010/0172519 | A1 * | 7/2010 | Kimura | H04R 1/1008 381/151 |
| 2011/0299695 | A1 * | 12/2011 | Nicholson | G10K 11/17833 381/71.6 |
| 2013/0216050 | A1 | 8/2013 | Chen et al. | |
| 2013/0278631 | A1 | 10/2013 | Border et al. | |
| 2014/0278393 | A1 | 9/2014 | Ivanov et al. | |

* cited by examiner

MULTI-MODE NOISE CANCELLATION FOR VOICE DETECTION

BACKGROUND

In industrial settings a user may need to provide maintenance or perform other duties associated with complex equipment and be required to consult a large amount of technical documentation, which is generally provided to a user via binders, tablets, or laptops. There are, however, inherent inefficiencies associated with methodologies involving having to navigate and find the desired information this way. Finding required content through manual navigation or through touch-based systems can be an ineffective use of time and require a user to stop and restart tasks in order to do so. Increasingly popular in many devices today, voice navigation provides an alternative to manual navigation or touch-based systems. However, ambient noise in many settings can make voice navigation difficult, if not impossible. As a result, the accuracy of interpreting voice commands suffers greatly and the user is unable to take advantage of voice navigation capabilities.

SUMMARY OF THE INVENTION

This summary is provided to introduce a selection of concepts in a simplified form that are further described below in the Detailed Description. This summary is not intended to identify key or essential features of the claimed subject matter, nor is it intended to be used as an aid in determining the scope of the claimed subject matter.

At a high level, embodiments of the present invention are generally directed to facilitating the access and the use of electronic content on a wearable device through hands-free operation. More particularly, in situations where ambient noise prevents voice navigation from accurately interpreting voice commands, the methods and systems described herein provide dynamic activation and deactivation of microphones to provide multi-mode noise cancellation for a voice-detecting headset. To do so, when an ambient noise is detected that exceeds a threshold, a plurality of noise-detecting microphones is activated. The noise-detecting microphone(s) receiving the highest level of ambient noise remains activated while the remaining noise-detecting microphones may be deactivated. A speech signal received by the speech microphone can then be optimized by cancelling the ambient noise signal received from the activated noise-detecting microphone(s). After the speech signal is optimized, it can be communicated to the voice-detecting headset for interpretation.

Additional objects, advantages, and novel features of the invention will be set forth in part in the description which follows, and in part will become apparent to those skilled in the art upon examination of the following, or may be learned by practice of the invention.

BRIEF DESCRIPTION OF THE DRAWINGS

The features of the invention noted above are explained in more detail with reference to the embodiments illustrated in the attached drawing figures, in which like reference numerals denote like elements, in which FIGS. 1-6 illustrate an embodiment of the present invention and in which:

FIG. 1 provides a schematic diagram showing an exemplary operating environment for a noise cancellation system in accordance with some implementations of the present disclosure;

FIG. 3 provides an illustrative process flow depicting a method for dynamically activating a plurality of noise-detecting microphones, in accordance with some implementations of the present disclosure;

FIG. 4 provides an illustrative process flow depicting a method for selecting one of the noise-detecting microphones for noise cancellation, in accordance with some implementations of the present disclosure;

FIG. 5 provides an illustrative process flow depicting a method for optimizing a voice signal, in accordance with some implementations of the present disclosure; and FIG. 6 provides a block diagram of an exemplary computing device in which some implementations of the present disclosure may be employed.

DETAILED DESCRIPTION

Figure 1:
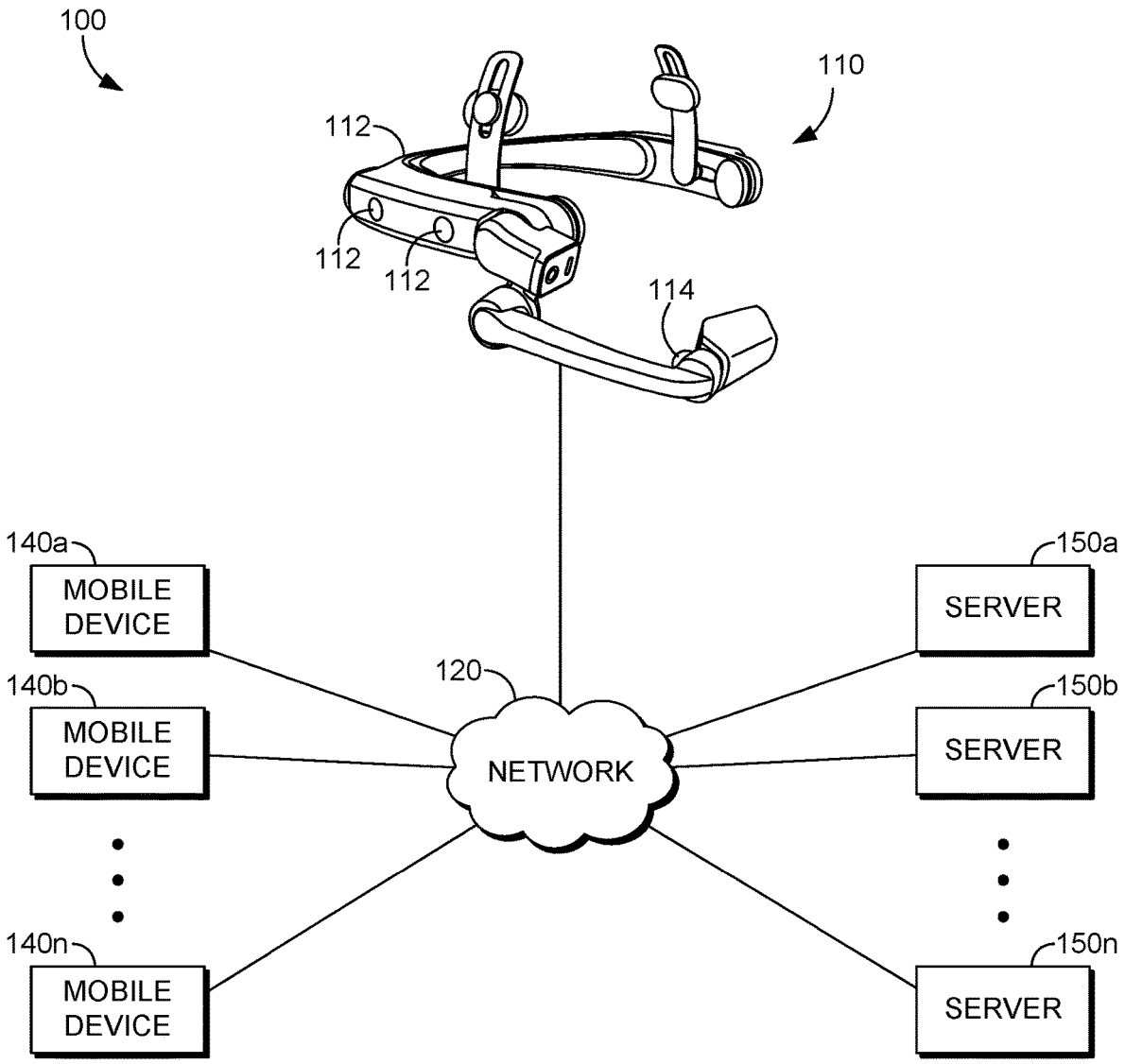

The subject matter of the present disclosure is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. For example, although this disclosure refers to situations where ambient noise prevents voice navigation from accurately interpreting voice commands in illustrative examples, aspects of this disclosure can be applied to situations where ambient noise prevents voice communications from being clearly communicated to another user(s) (e.g., cellular communications, SKYPE communications, or any other application or method of communications between user(s) that can be accomplished using a voice-detecting headset).

Moreover, although the terms "step" and/or "block" may be used herein to connote different elements of methods employed, the terms should not be interpreted as implying any particular order among or between various steps herein disclosed unless and except when the order of individual steps is explicitly described. As used herein, the singular forms "a," "an," and "the" are intended to include the plural forms as well, unless the context clearly indicates otherwise.

As noted in the Background, in industrial settings a user may need to provide maintenance or perform other duties associated with complex equipment and be required to consult a large amount of technical documentation, which is generally provided to a user via binders, tablets, or laptops. Inherent inefficiencies associated with methodologies involving consultation with such resources is impractical. For example, finding required content through manual navigation or through touch-based systems can be an ineffective use of time and require a user to stop and restart tasks in order to do so. The use of voice navigation has become increasingly popular in many devices today and provides an alternative to manual navigation or touch-based systems. However, ambient noise in many settings can prevent voice navigation from being a feasible alternative. For example, when ambient noise reaches a particular threshold, the accuracy of interpreting voice commands suffers greatly and the user is unable to take advantage of voice navigation capabilities.

Embodiments of the present disclosure are generally directed to providing multi-mode noise cancellation for a voice-detecting headset comprising a speech microphone and a plurality of noise-detecting microphones. In some embodiments, when an ambient noise is detected, a sensed energy level of that ambient noise is compared to a threshold (e.g., 85 dB). In one aspect, based on the sensed energy level's position (e.g., below or above) with respect to the threshold, a particular noise-cancelling algorithm can be selected by a processor and employed to facilitate noise-cancellation. For instance, if the sensed energy level is lower than the threshold, a first noise-cancelling algorithm optimized for filtering out the voices of nearby speakers can be selected by a processor and employed to optimize audio inputs received by a speech microphone. In another instance, if the sensed energy level is higher than the threshold, a second noise-cancelling algorithm optimized for filtering out high-noise environments can be selected by the processor and employed to optimize audio inputs received by the speech microphone.

In another aspect, when the sensed energy level of an ambient noise exceeds a threshold (e.g., 85 dB) the plurality of noise-detecting microphones can be activated. The noise-detecting microphone(s) receiving the highest level of ambient noise can remain activated while the remaining noise-detecting microphone(s) may be deactivated. A speech signal received by the speech microphone can then be optimized by cancelling the ambient noise signal received from the activated noise-detecting microphone(s). After the speech signal is optimized, it can be communicated to the voice-detecting headset for interpretation (described in more detail below with respect to FIG. 6).

The ability to accurately navigate relevant content through the use of a voice-detecting headset is an important aspect for user workflow and operation in particular scenarios. For example, this may be true in industrial applications where ambient noise may otherwise prevent a user from accurately communicating voice commands to the voice-detecting headset. Consequently, embodiments of the present disclosure enable the user to accurately navigate a potentially large volume of content quickly and while maintaining interaction with the technology while concurrently engaged in other tasks.

Utilizing a wearable device comprising a voice-detecting headset in accordance with embodiments of the present disclosure, such as, for example, a head-mounted computing device including a display, a user may view and accurately navigate a large amount of documentation or other content using the display as a viewer even where ambient noise may otherwise prevent a user from accurately communicating voice commands to the voice-detecting headset. In accordance with some embodiments of the present disclosure, the display acts as a window onto a larger virtual space, allowing a user to accurately navigate to a specified page within a specific document, zoom into and out of a page achieving various levels of magnification, and utilize hands-free movements to pan longitudinally or vertically over a page to arrive at desired XY coordinate of a stationary document within the larger virtual space.

In some embodiments of the present disclosure, communications with other devices and/or applications may be enhanced by the noise cancellation features of the voice-detecting headset. For example, a user in the same industrial setting may need to communicate with another user in the same industrial setting or another setting also having ambient noise. The noise cancellation features described herein provide more accuracy in the voice signals communicated from one user to the other user even where ambient noise may otherwise prevent a user from accurately communicating voice signals to the voice-detecting headset.

As such, embodiments of the present invention are directed towards multi-mode noise cancellation for voice detection using a wearable device comprising a voice-detecting headset, for example a head-mounted computing device. In this way, aspects of the present disclosure relate to devices, methods, and systems that facilitate more accurate voice detection to communicate with other users and navigate various content and user interfaces.

FIG. 1 depicts aspects of an operating environment 100 for a noise cancellation system in accordance with various embodiments of the present disclosure. Operating environment 100 may include, among other components, a wearable device(s) 110, mobile device(s) 140*a*-140*n*, and server(s) 150*a*-150*n*. The components can be configured to be in operable communication with one another via a network 120.

The wearable device 110 includes any computing device, more particularly any head-mounted computing device (e.g. a mounted tablet, display system, smart glasses, hologram device). The wearable device 120 can include a display component, for example a display that can present information through visual, auditory, and/or other tactile cues (e.g., a display, a screen, a lamp, a light-emitting diode (LED), a graphical user interface (GUI), and the like). The display component may, for example, present an augmented reality (AR) view to a user, that is a live direct or indirect view of the physical real world environment supplemented by computer generated sensory input. In some embodiments, the wearable device 120 may have an imaging or optical input component.

Figure 2A:
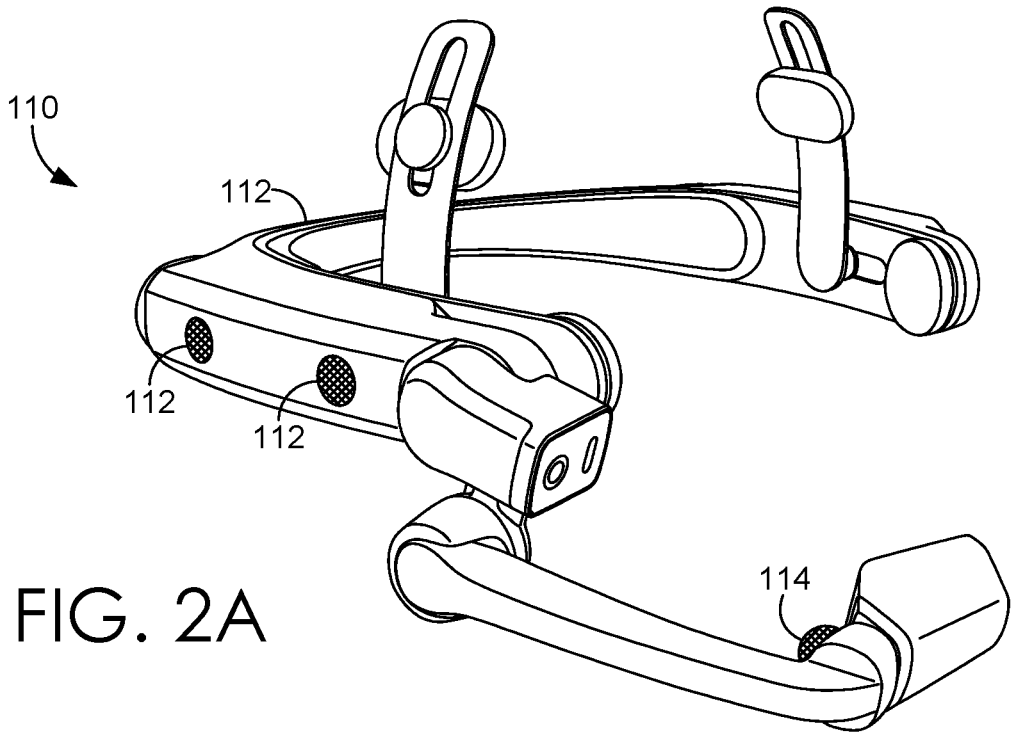
FIGS. 2A-2B provide perspective views of an exemplary wearable device, in accordance with some implementations of the present disclosure.
Figure 2B:
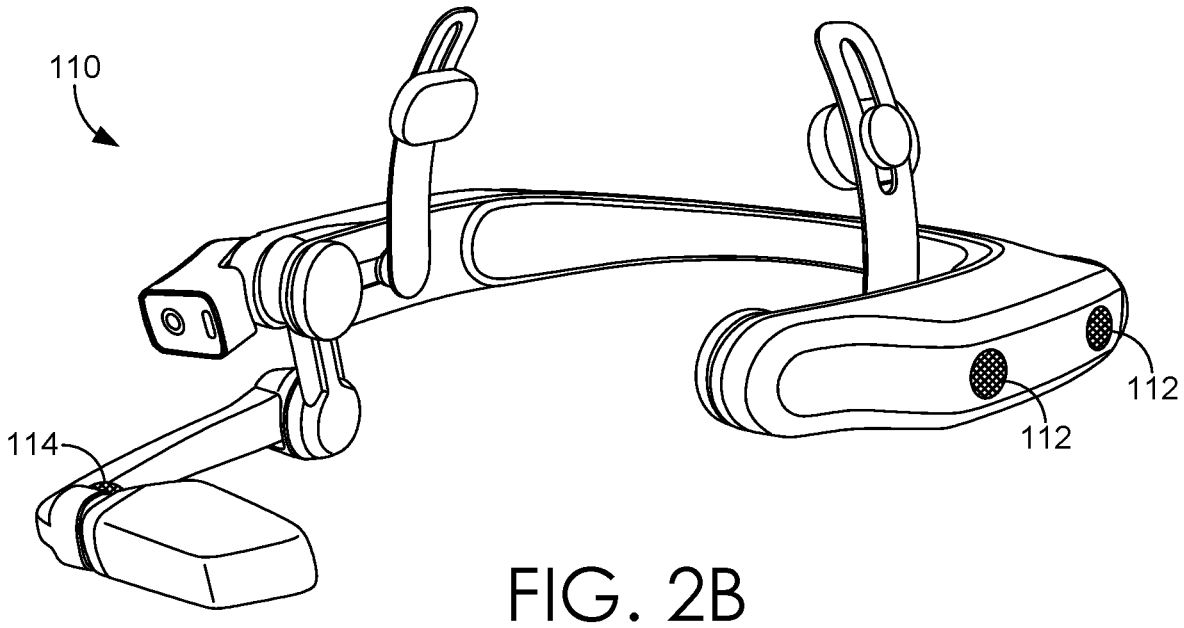

As shown in FIGS. 1 and 2A-2B, the wearable device 110 also includes a speech microphone 114 and a plurality of noise detecting microphones 112. As explained in more detail below, the noise detecting microphones 112 detect an ambient noise signal. A speech signal received by the speech microphone 114 can be optimized by cancelling the ambient noise signal from the speech signal. This enables a user of the wearable device 110 to more effectively communicate via the wearable device. For example, the user may be utilizing voice commands to control functionality of a head-mounted computing device. Or the user may be communicating with other users that may be utilizing a mobile device(s) 140*a*-140*n* or services running on server(s) 150*a*-150*n*. As can be appreciated, when the ambient noise signal is cancelled form the speech signal, other users are able to hear the user more clearly and/or voice commands are interpreted more accurately.

In practice and referring back to FIG. 1, a user may initialize the wearable device 110. For example, the user may power on the wearable device. As the wearable device powers on, the speech microphone 114 may also be initialized. Once the speech microphone has initialized, it is ready to detect speech signals. For example, if the user is relying on voice navigation, the speech microphone detects the speech signal that may be interpreted by the wearable device 110 as voice commands. If the user is attempting with other users that may be utilizing mobile device(s) 140*a*-140*n* or services running on server(s) 150*a*-150*n*, the speech signals may be communicated via the wearable device 110 to mobile device(s) 140*a*-140*n* or server(s) 150*a*-150*n*.

While the wearable device 110 is powered on, the speech microphone 113 may also detect noise signals (e.g., ambient noise). If the sound level of the ambient noise reaches a configurable threshold (e.g., 85 dB), the wearable device 110 can select a particular noise-cancelling algorithm optimal for filtering out high level noises and/or initialize a plurality of noise detecting microphones 112 to facilitate the noise cancellation. For example, the wearable device 110 may include one or more noise detecting microphones 112 (e.g., in an array) on a headband of the wearable device 110. A processor of the wearable device 110 can then determine one or more noise detecting microphone(s) 112 that is detecting the highest sound levels of the ambient noise and can power off the remaining noise detecting microphone(s).

Similarly, if the sound level of the ambient noise does not reach the configurable threshold, the wearable device 110 can select or default to a different noise-cancelling algorithm optimal for filtering out audio signals of nearby speakers and/or initialize one or more noise detecting microphones 112 to facilitate the noise-cancellation. For example, the wearable device 110 may include one or more noise detecting microphones 112 (e.g., in an array) on a headband of the wearable device 110. A processor of the wearable device 110 can then determine one or more noise detecting microphone(s) 112 that is detecting the highest sound levels of the ambient noise and can power off the remaining noise detecting microphone(s).

In some embodiments, the wearable device 110 can dynamically change noise-cancellation algorithms and/or power on and off various noise detecting microphones based on a variety of factors. For example, if the noise detecting microphone experiences a sudden change in the sound level of the ambient noise, the wearable device 110 can power on all noise detecting microphones and determine if a different noise detecting microphone is detecting the highest sound level of the ambient noise. Or, the wearable device can detect that the user has changed directions, orientation, or position such that a different noise detecting microphone can be a better candidate for noise cancellation. In some embodiments, if the voice signal is not being interpreted properly as a voice command, the wearable device may select a new noise-cancelling algorithm and/or reinitialize the plurality of noise detecting microphones 112 to determine if a different noise cancelling algorithm or a different noise detecting microphone may provide better noise cancellation for the environment.

In some embodiments, after the noise detecting microphone detecting the highest sound level of the ambient noise has been selected by the wearable device 110, any method of noise cancellation may be utilized by the wearable device 110. By way of a non-limiting example, the wearable device 110 can generate a noise-cancelling wave that is one hundred eighty degrees out of phase with the ambient noise. The noise-cancelling wave cancels out the ambient noise and enables the wearable device 110 to receive, interpret, and communicate the speech signals with much greater accuracy and clarity. In another non-limiting example, the signals received by the active noise detecting microphone(s) can be employed by a processor to, in essence, subtract the received ambient noise signals from the audio signals received by the speech microphone.

Figure 3:
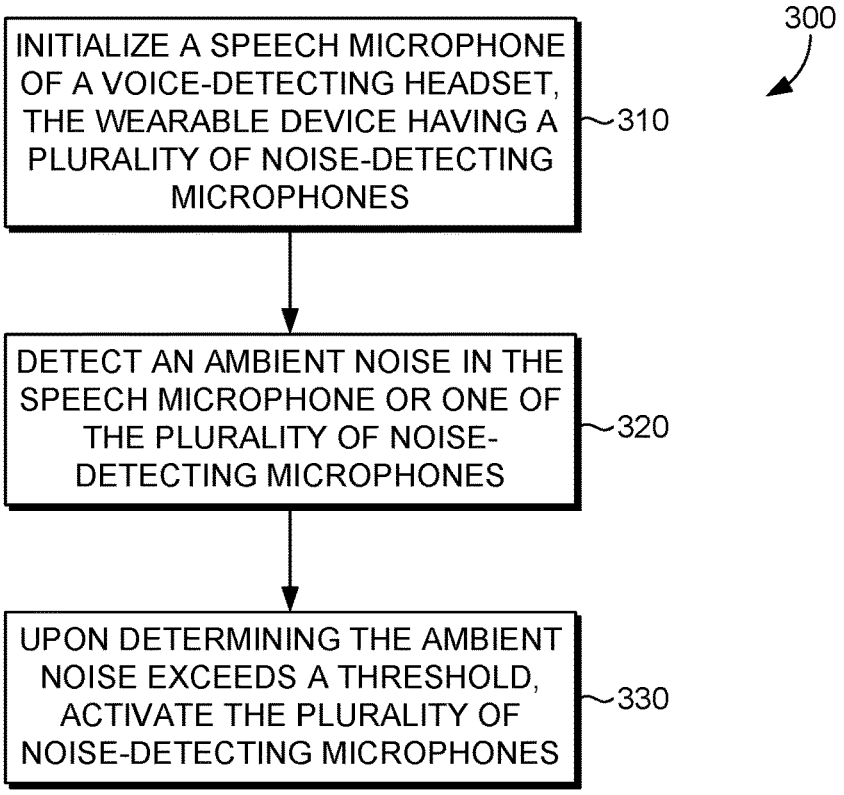

Having described various aspects of the present disclosure, exemplary methods are described below for providing multi-mode noise cancellation for voice detection, in accordance with some implementations of the present disclosure. Referring initially to FIG. 3 in light of FIGS. 1-2, a flow diagram illustrates a method 300 for dynamically activating a plurality of noise-detecting microphones, in accordance with some implementations of the present disclosure. Each block of method 300 comprises a computing process that may be performed using any combination of hardware, firmware, and/or software. For instance, various functions may be carried out by a processor executing instructions stored in memory. The methods may also be embodied as computer-usable instructions stored on computer storage media. The methods may be provided by a standalone application, a service or hosted service (standalone or in combination with another hosted service), or a plug-in to another product, to name a few.

Initially, at block 310, a speech microphone of a voice-detecting headset is initialized. The voice detecting headset may also comprise a plurality of noise-detecting microphones. The noise-detecting microphones may be arranged in an array around a headband of the voice-detecting headset.

At block 320, an ambient noise is detected in the speech microphone or one of the plurality of noise-detecting microphones. In some embodiments, the speech microphone is a bone-conducting microphone. In some embodiments, the speech microphone is cheek microphone. In some embodiments, at least one of the noise-detecting microphones is a third party microphone. In this example, the voice-detecting headset may dynamically deactivate the noise-detecting microphones and activate the third party microphone. The third party microphone can then receive the ambient noise signal.

At block 330, upon determining the ambient noise exceeds a threshold, the plurality of noise-detecting microphones is activated. In some embodiments, at least one of the noise-detecting microphones is a stand-alone microphone that is in proximity to the voice-detecting headset.

Figure 4:
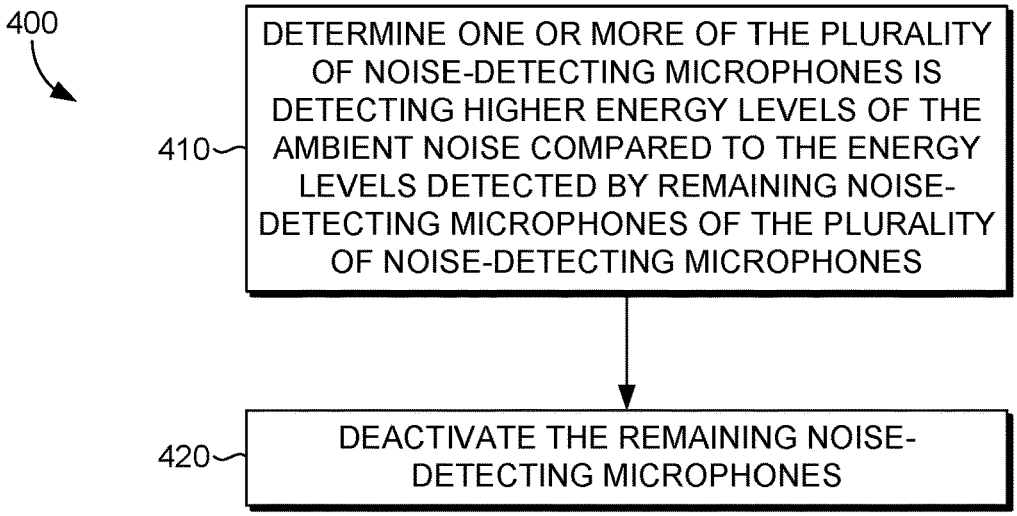

Referring next to FIG. 4, in light of FIGS. 1-2, a flow diagram illustrates a method 400 for selecting one of the noise-detecting microphones for noise cancellation, in accordance with some implementations of the present disclosure. Each block of method 400 comprises a computing process that may be performed using any combination of hardware, firmware, and/or software. For instance, various functions may be carried out by a processor executing instructions stored in memory. The methods may also be embodied as computer-usable instructions stored on computer storage media. The methods may be provided by a standalone application, a service or hosted service (standalone or in combination with another hosted service), or a plug-in to another product, to name a few.

Initially, at block 410, it is determined which one or more of the plurality of noise-detecting microphones is detecting higher energy levels of the ambient noise compared to the energy levels detected by remaining noise-detecting microphones of the plurality of noise-detecting microphones. At block 420, the remaining noise-detecting microphones are deactivated.

Figure 5:
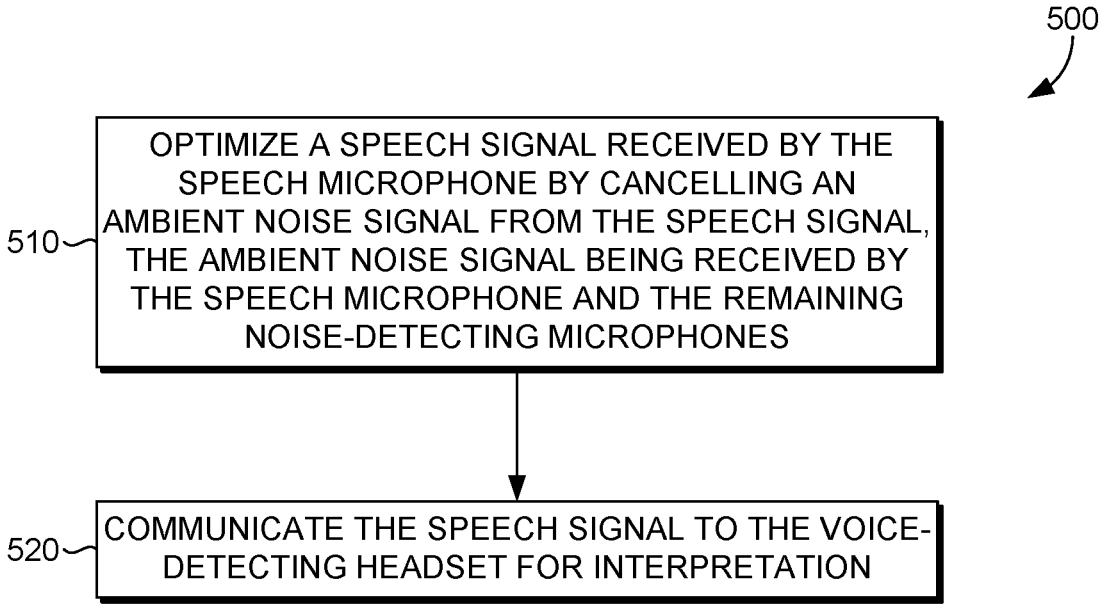

Turning now to FIG. 5 in light of FIGS. 1-2, a flow diagram illustrates a method 500 for optimizing a voice signal, in accordance with some implementations of the present disclosure. Each block of method 500 comprises a computing process that may be performed using any combination of hardware, firmware, and/or software. For instance, various functions may be carried out by a processor executing instructions stored in memory. The methods may also be embodied as computer-usable instructions stored on computer storage media. The methods may be provided by a standalone application, a service or hosted service (standalone or in combination with another hosted service), or a plug-in to another product, to name a few.

At block 510, a speech signal received by the speech microphone is optimized by cancelling an ambient noise signal from the speech signal. The ambient noise signal is received by the speech microphone and the remaining noise-detecting microphone. At block 520, the speech signal is communicated to the voice-detecting headset for interpretation.

Example Computing System

Figure 6:
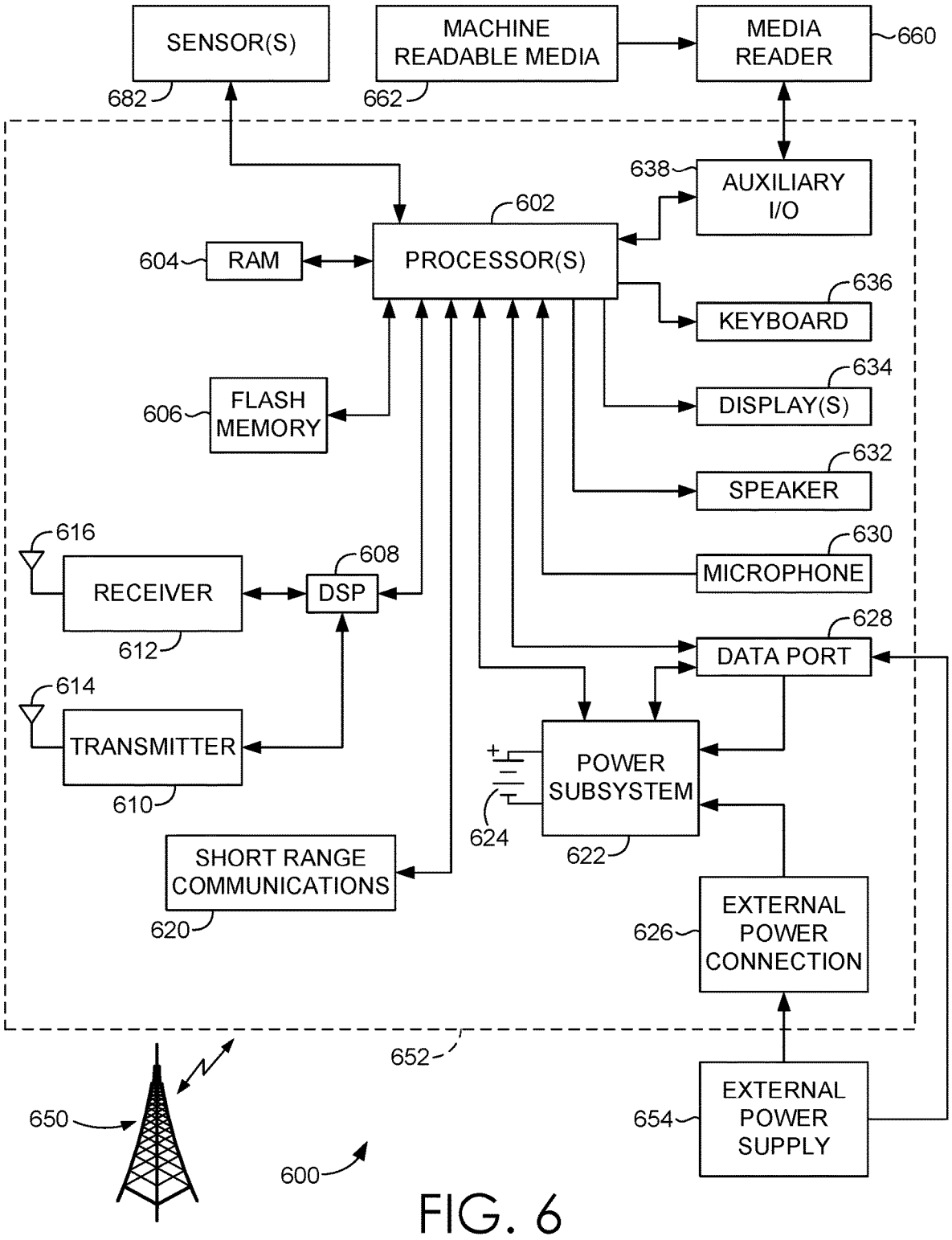

Wearable device 110 can contain one or more of the electronic components listed elsewhere herein, including a computing system. An example block diagram of such a computing system 600 is illustrated in FIG. 6. In this example, an electronic device 652 is a wireless two-way communication device with voice and data communication capabilities. Such electronic devices communicate with a wireless voice or data network 650 using a suitable wireless communications protocol. Wireless voice communications are performed using either an analog or digital wireless communication channel. Data communications allow the electronic device 652 to communicate with other computer systems via the Internet. Examples of electronic devices that are able to incorporate the above described systems and methods include, for example, a data messaging device, a two-way pager, a cellular telephone with data messaging capabilities, a wireless Internet appliance or a data communication device that may or may not include telephony capabilities.

The illustrated electronic device 652 is an exemplary electronic device that includes two-way wireless communications functions. Such electronic devices incorporate communication subsystem elements such as a wireless transmitter 610, a wireless receiver 612, and associated components such as one or more antenna elements 614 and 616. A digital signal processor (DSP) 608 performs processing to extract data from received wireless signals and to generate signals to be transmitted. The particular design of the communication subsystem is dependent upon the communication network and associated wireless communications protocols with which the device is intended to operate.

The electronic device 652 includes a microprocessor 602 that controls the overall operation of the electronic device 652. The microprocessor 602 interacts with the above described communications subsystem elements and also interacts with other device subsystems such as flash memory 606, random access memory (RAM) 604, auxiliary input/output (I/O) device 638, data port 628, display 634, keyboard 636, speaker 632, microphone 630, a short-range communications subsystem 620, a power subsystem 622, and any other device subsystems.

A battery 624 is connected to a power subsystem 622 to provide power to the circuits of the electronic device 652. The power subsystem 622 includes power distribution circuitry for providing power to the electronic device 652 and also contains battery charging circuitry to manage recharging the battery 624. The power subsystem 622 includes a battery monitoring circuit that is operable to provide a status of one or more battery status indicators, such as remaining capacity, temperature, voltage, electrical current consumption, and the like, to various components of the electronic device 652.

The data port 628 is able to support data communications between the electronic device 652 and other devices through various modes of data communications, such as high speed data transfers over an optical communications circuits or over electrical data communications circuits such as a USB connection incorporated into the data port 628 of some examples. Data port 628 is able to support communications with, for example, an external computer or other device.

Data communication through data port 628 enables a user to set preferences through the external device or through a software application and extends the capabilities of the device by enabling information or software exchange through direct connections between the electronic device 652 and external data sources rather than via a wireless data communication network. In addition to data communication, the data port 628 provides power to the power subsystem 622 to charge the battery 624 or to supply power to the electronic circuits, such as microprocessor 602, of the electronic device 652.

Operating system software used by the microprocessor 602 is stored in flash memory 606. Further examples are able to use a battery backed-up RAM or other non-volatile storage data elements to store operating systems, other executable programs, or both. The operating system software, device application software, or parts thereof, are able to be temporarily loaded into volatile data storage such as RAM 604. Data received via wireless communication signals or through wired communications are also able to be stored to RAM 604.

The microprocessor 602, in addition to its operating system functions, is able to execute software applications on the electronic device 652. A predetermined set of applications that control basic device operations, including at least data and voice communication applications, is able to be installed on the electronic device 652 during manufacture. Examples of applications that are able to be loaded onto the device may be a personal information manager (PIM) application having the ability to organize and manage data items relating to the device user, such as, but not limited to, e-mail, calendar events, voice mails, appointments, and task items.

Further applications may also be loaded onto the electronic device 652 through, for example, the wireless network 650, an auxiliary I/O device 638, Data port 628, short-range communications subsystem 620, or any combination of these interfaces. Such applications are then able to be installed by a user in the RAM 604 or a non-volatile store for execution by the microprocessor 602.

In a data communication mode, a received signal such as a text message or web page download is processed by the communication subsystem, including wireless receiver 612 and wireless transmitter 610, and communicated data is provided to the microprocessor 602, which is able to further process the received data for output to the display 634, or alternatively, to an auxiliary I/O device 638 or the data port 628. A user of the electronic device 652 may also compose data items, such as e-mail messages, using the keyboard 636, which is able to include a complete alphanumeric keyboard or a telephone-type keypad, in conjunction with the display 634 and possibly an auxiliary I/O device 638. Such composed items are then able to be transmitted over a communication network through the communication subsystem.

For voice communications, overall operation of the electronic device 652 is substantially similar, except that received signals are generally provided to a speaker 632 and signals for transmission are generally produced by a microphone 630. Alternative voice or audio I/O subsystems, such as a voice message recording subsystem, may also be implemented on the electronic device 652. Although voice or audio signal output is generally accomplished primarily through the speaker 632, the display 634 may also be used to provide an indication of the identity of a calling party, the duration of a voice call, or other voice call related information, for example.

Depending on conditions or statuses of the electronic device 652, one or more particular functions associated with a subsystem circuit may be disabled, or an entire subsystem circuit may be disabled. For example, if the battery temperature is low, then voice functions may be disabled, but data communications, such as e-mail, may still be enabled over the communication subsystem.

A short-range communications subsystem 620 provides for data communication between the electronic device 652 and different systems or devices, which need not necessarily be similar devices. For example, the short-range communications subsystem 620 includes an infrared device and associated circuits and components or a Radio Frequency based communication module such as one supporting Bluetooth® communications, to provide for communication with similarly-enabled systems and devices, including the data file transfer communications described above.

A media reader 660 connectable to an auxiliary I/O device 638 to allow, for example, loading computer readable program code of a computer program product into the electronic device 652 for storage into flash memory 606. One example of a media reader 660 is an optical drive such as a CD/DVD drive, which may be used to store data to and read data from a computer readable medium or storage product such as computer readable storage media 662. Examples of suitable computer readable storage media include optical storage media such as a CD or DVD, magnetic media, or any other suitable data storage device. Media reader 660 is alternatively able to be connected to the electronic device through the data port 628 or computer readable program code is alternatively able to be provided to the electronic device 652 through the wireless network 650.

All references cited herein are expressly incorporated by reference in their entirety. It will be appreciated by persons skilled in the art that the present disclosure is not limited to what has been particularly shown and described herein above. In addition, unless mention was made above to the contrary, it should be noted that all of the accompanying drawings are not to scale. There are many different features to the present disclosure and it is contemplated that these features may be used together or separately. Thus, the disclosure should not be limited to any particular combination of features or to a particular application of the disclosure.

Many variations can be made to the illustrated embodiment of the present invention without departing from the scope of the present invention. Such modifications are within the scope of the present invention. Embodiments presented herein have been described in relation to particular embodiments which are intended in all respects to be illustrative rather than restrictive. Alternative embodiments and modifications would be readily apparent to one of ordinary skill in the art, but would not depart from the scope of the present invention.

From the foregoing it will be seen that this invention is one well adapted to attain all ends and objects hereinabove set forth together with the other advantages which are obvious and which are inherent to the structure. It will be understood that certain features and subcombinations are of utility and may be employed without reference to other features and sub combinations. This is contemplated by and is within the scope of the invention.

In the preceding detailed description, reference is made to the accompanying drawings which form a part hereof wherein like numerals designate like parts throughout, and in which is shown, by way of illustration, embodiments that may be practiced. It is to be understood that other embodiments may be utilized and structural or logical changes may be made without departing from the scope of the present disclosure. Therefore, the preceding detailed description is not to be taken in the limiting sense, and the scope of embodiments is defined by the appended claims and their equivalents.

Various aspects of the illustrative embodiments have been described using terms commonly employed by those skilled in the art to convey the substance of their work to others skilled in the art. However, it will be apparent to those skilled in the art that alternate embodiments may be practiced with only some of the described aspects. For purposes of explanation, specific numbers, materials, and configurations are set forth in order to provide a thorough understanding of the illustrative embodiments. However, it will be apparent to one skilled in the art that alternate embodiments may be practiced without the specific details. In other instances, well-known features have been omitted or simplified in order not to obscure the illustrative embodiments.

Various operations have been described as multiple discrete operations, in turn, in a manner that is most helpful in understanding the illustrative embodiments; however, the order of description should not be construed as to imply that these operations are necessarily order dependent. In particular, these operations need not be performed in the order of presentation. Further, descriptions of operations as separate operations should not be construed as requiring that the operations be necessarily performed independently and/or by separate entities. Descriptions of entities and/or modules as separate modules should likewise not be construed as requiring that the modules be separate and/or perform separate operations. In various embodiments, illustrated and/or described operations, entities, data, and/or modules may be merged, broken into further sub-parts, and/or omitted.

The phrase "in one embodiment" or "in an embodiment" is used repeatedly. The phrase generally does not refer to the same embodiment; however, it may. The terms "comprising," "having," and "including" are synonymous, unless the context dictates otherwise. The phrase "A/B" means "A or B." The phrase "A and/or B" means "(A), (B), or (A and B)." The phrase "at least one of A, B, and C" means "(A), (B), (C), (A and B), (A and C), (B and C), or (A, B, and C)."

What is claimed is:

1. A computer-implemented method of multi-modal noise cancellation for voice detection in a voice-detecting headset, the method comprising:

initializing a speech microphone of the voice-detecting headset, the voice-detecting headset having a plurality of noise-detecting microphones;

detecting an ambient noise in the speech microphone;

upon determining the ambient noise detected in the speech microphone exceeds a threshold, activating the plurality of noise-detecting microphones;

determining that one or more of the plurality of noise-detecting microphones is detecting higher energy levels of the ambient noise compared to the energy levels detected by remaining noise-detecting microphones of the plurality of noise-detecting microphones;

dynamically selecting a noise-cancelling algorithm from a plurality of different noise-cancelling algorithms based on at least one sound characteristic of the ambient noise detected by the one or more of the plurality of noise-detecting microphones; and optimizing a speech signal received by the speech microphone by cancelling an ambient noise signal in the speech signal using the dynamically selected noise-cancelling algorithm, the ambient noise signal being received by the speech microphone and the one or more of the plurality of noise-detecting microphones detecting the higher energy levels of the ambient noise than the remaining noise-detecting microphones of the plurality of noise-detecting microphones.

2. The computer-implemented method of claim 1, further comprising, after the speech signal is optimized, communicating the speech signal to the voice-detecting headset for interpretation.

3. The computer-implemented method of claim 1, further comprising deactivating the remaining noise-detecting microphones.

4. The computer-implemented method of claim 1, wherein at least one of the plurality of noise-detecting microphones is a stand-alone microphone that is located in proximity to the voice-detecting headset.

5. The computer-implemented method of claim 1, wherein the speech microphone is a bone-conducting microphone.

6. The computer-implemented method of claim 1, wherein the speech microphone is a cheek microphone.

7. The computer-implemented method of claim 1, wherein the dynamically selected noise-cancelling algorithm is useable for filtering out voices of nearby speakers.

8. The computer-implemented method of claim 1, wherein the dynamically selected noise-cancelling algorithm is useable for filtering out high-noise environments.

9. The computer-implemented method of claim 1, wherein the voice-detecting headset comprises a head-mounted computing device having a display, and wherein the dynamically selected noise-cancelling algorithm is initiated by a processor of the head-mounted computing device.

10. The computer-implemented method of claim 1, wherein the dynamically selected noise-cancelling algorithm is selected based on the detected ambient noise being above or below a threshold.

11. At least one non-transitory computer storage media, having instructions stored thereon that, when executed by at least one processor of a computing system, cause the computing system to:

initialize a speech microphone of a voice-detecting headset, the voice-detecting headset also having a plurality of noise-detecting microphones;

detect an ambient noise in a speech signal received by the speech microphone;

dynamically select a noise-cancelling algorithm from a plurality of different noise-cancelling algorithms based at least on a sensed energy level of the detected ambient noise, wherein the selected noise-cancelling algorithm comprises:

a first noise-cancelling algorithm useable for reducing a first type of ambient noise signal present in the speech signal, the first noise-cancelling algorithm selected based on the sensed energy level being below a threshold, or a second noise-cancelling algorithm useable for reducing a second type of ambient noise signal present in the speech signal, wherein the second noise-cancelling algorithm is selected based on the sensed energy level being above the threshold;

optimize the speech signal received by the speech microphone by cancelling an ambient noise signal from the speech signal using the dynamically selected noise-cancelling algorithm, the ambient noise signal being received by the speech microphone and at least one dynamically selected noise-detecting microphone of the plurality of noise-detecting microphones; and communicate the optimized speech signal to the voice-detecting headset for interpretation.

12. The at least one non-transitory computer storage media of claim 11, wherein the dynamically selected noise-detecting microphone is determined based on one of the plurality of noise-detecting microphones detecting higher energy levels of the ambient noise compared to energy levels of the ambient noise detected by remaining noise-detecting microphones of the plurality of noise-detecting microphones.

13. The at least one non-transitory computer storage media of claim 12, wherein the voice-detecting headset comprises a head-mounted computing device having a display, and wherein the dynamically selected noise-cancelling algorithm is initiated by the at least one processor which forms part of the head-mounted computing device.

14. The at least one non-transitory computer storage media of claim 12, further comprising deactivating the remaining noise-detecting microphones.

15. The at least one non-transitory computer storage media of claim 11, wherein the first noise-cancelling algorithm is useable for filtering out voices of nearby speakers, and wherein the second noise-cancelling algorithm is useable for filtering out high-noise environments.

16. A computerized system comprising:

at least one processor; and at least one computer storage media storing computer-useable instructions thereon that, when executed by the at least one processor, causes the at least one processor to:

detect an ambient noise in a speech signal received by a voice-detecting headset comprising a speech microphone and a plurality of noise-detecting microphones;

dynamically select a noise-cancelling algorithm from a plurality of different noise-cancelling algorithms based on a detected ambient noise level, wherein the dynamically selected noise-cancelling algorithm comprises:

a first noise-cancelling algorithm useable for reducing a first type of ambient noise signal present in the speech signal, the first noise-cancelling algorithm selected based on the detected ambient noise level being below a threshold, or a second noise-cancelling algorithm useable for reducing a second type of ambient noise signal present in the speech signal, the second noise-cancelling algorithm selected based on the detected ambient noise level being above the threshold;

determine that one or more of the plurality of noise-detecting microphones is detecting higher energy levels of the ambient noise compared to energy levels of the ambient noise detected by the remaining noise-detecting microphones; and optimize the speech signal received by the speech microphone by cancelling an ambient noise signal from the speech signal using the dynamically selected noise-cancelling algorithm, the ambient noise signal received at least by the speech microphone and the one or more of the plurality of noise-detecting microphones.

17. The computerized system of claim 16, wherein the first noise-cancelling algorithm is useable for filtering out voices of nearby speakers, and wherein the second noise-cancelling algorithm is useable for filtering out high-noise environments.

18. The computerized system of claim 16, further comprising deactivating the remaining noise-detecting microphones.

19. The computerized system of claim 16, wherein the voice-detecting headset comprises a head-mounted computing device having a display, and wherein the dynamically selected noise-cancelling algorithm is initiated by the at least one processor which forms part of the head-mounted computing device.

20. The computerized system of claim 16, wherein the dynamically selected noise-cancelling algorithm is suited for filtering out the ambient noise signal received by the speech microphone and the one or more of the plurality of noise-detecting microphones.

* * * * *